US011174762B1

(12) United States Patent
Kenyon et al.

(10) Patent No.: US 11,174,762 B1
(45) Date of Patent: Nov. 16, 2021

(54) VCT VALVE WITH REED CHECK

(71) Applicant: BorgWarner Inc., Auburn Hills, MI (US)

(72) Inventors: Brian T. Kenyon, McGraw, NY (US); Matthew Minnig, Ithaca, NY (US)

(73) Assignee: BORGWARNER, INC., Auburn Hills, MI (US)

( * ) Notice: Subject to any disclaimer, the term of this patent is extended or adjusted under 35 U.S.C. 154(b) by 0 days.

(21) Appl. No.: 16/993,704

(22) Filed: Aug. 14, 2020

(51) Int. Cl.
*F01L 1/34* (2006.01)
*F01L 1/344* (2006.01)

(52) U.S. Cl.
CPC ..... *F01L 1/3442* (2013.01); *F01L 2001/3443* (2013.01); *F01L 2001/34433* (2013.01); *F01L 2001/34453* (2013.01)

(58) Field of Classification Search
CPC ..... F01L 1/3442; F01L 2001/3443; F01L 2001/34433; F01L 2001/34453
See application file for complete search history.

(56) References Cited

U.S. PATENT DOCUMENTS 7,600,531 B2 10/2009 Patze et al.
8,695,550 B2 4/2014 Ikuma
9,422,840 B2 8/2016 Parker et al.
10,132,419 B2 11/2018 Schmidt
10,605,127 B2 3/2020 Benischek et al.
2015/0233481 A1 8/2015 Shimura
2016/0108774 A1* 4/2016 Pietrzyk ..... F01L 1/34409 123/90.1
2019/0323388 A1 10/2019 Mitsutani

FOREIGN PATENT DOCUMENTS

JP 5720738 B2 5/2015
JP 5811351 B2 11/2015

* cited by examiner

*Primary Examiner* — Zelalem Eshete
(74) *Attorney, Agent, or Firm* — Reising Ethington P.C.

(57) ABSTRACT

A variable camshaft timing (VCT) control valve assembly includes: a control valve having one or more lands and a valve cavity; one or more cavity vents in the control valve are configured to communicate fluid between an outer surface of the control valve and the valve cavity; a valve sleeve having a sleeve cavity that receives the control valve and a plurality of apertures, at least one of the apertures is configured to be in fluid communication with an advance fluid chamber of a VCT device and another of the apertures is configured to be in fluid communication with a retard fluid chamber; the control valve slides axially relative to the valve sleeve; and one or more reed valves, attached to an outer surface of the valve sleeve, configured to control the flow of fluid between one of the advance fluid chamber or the retard fluid chamber and the other of the advance fluid chamber or the retard fluid chamber.

20 Claims, 9 Drawing Sheets

VCT VALVE WITH REED CHECK

TECHNICAL FIELD

The present application relates to variable camshaft timing (VCT) and, more particularly, to check valves used with VCT devices.

BACKGROUND

Internal combustion engines (ICEs) use one or more camshafts to open and close intake and exhaust valves in response to cam lobes selectively actuating valve stems as the camshaft(s) rotate and overcome the force of valve springs that keep the valves seated. The shape and angular position of the cam lobes can impact the operation of the ICE. In the past, the angular position of the camshaft relative to the angular position of the crankshaft was fixed. But ICEs now can include a variable camshaft timing (VCT) device—sometimes referred to as a camshaft phaser—that varies the angular position of the camshaft relative to the angular position of the crankshaft. Camshaft phasers are often hydraulically-actuated and include a rotor having radially-outwardly-extending vanes that exist in fluid chambers formed within a stator. The camshaft phasers can rely on a control valve assembly that selectively flows fluid into portions of the chamber that are separated by the vanes to exert rotational force on the rotor thereby creating relative motion between the rotor and the stator. The flow of fluid can be controlled using one or more check valves. However, the inclusion of check valves can increase the overall size of the assembly. It would be helpful to include one or more check valves in the assembly while minimizing the overall size of the control valve assembly.

SUMMARY

In one implementation, a variable camshaft timing (VCT) control valve assembly includes: a control valve having one or more lands and a valve cavity; one or more cavity vents in the control valve are configured to communicate fluid between an outer surface of the control valve and the valve cavity; a valve sleeve having a sleeve cavity that receives the control valve and a plurality of apertures, at least one of the apertures is configured to be in fluid communication with an advance fluid chamber of a VCT device and another of the apertures is configured to be in fluid communication with a retard fluid chamber; the control valve slides axially relative to the valve sleeve; and one or more reed valves, on an outer surface of the valve sleeve, configured to control the flow of fluid between one of the advance fluid chamber or the retard fluid chamber and the other of the advance fluid chamber or the retard fluid chamber.

In another implementation, a VCT control valve assembly includes: a control valve having one or more lands and a valve cavity; one or more cavity vents are configured to communicate fluid between an outer surface of the control valve and the valve cavity; a valve sleeve having a sleeve cavity that receives the control valve and a plurality of apertures, at least one of the apertures is configured to be in fluid communication with an advance fluid chamber of a VCT device and another of the apertures is configured to be in fluid communication with a retard fluid chamber; the control valve slides axially relative to the valve sleeve; and a first reed valve, on an outer surface of the valve sleeve, configured to control the flow of fluid between the advance fluid chamber and the retard fluid chamber and a second reed valve, on an outer surface of the valve sleeve, configured to control the flow of fluid between the retard fluid chamber and the advance fluid chamber.

In yet another implementation, a VCT control valve assembly includes: a control valve having one or more lands and a valve cavity; one or more cavity vents are configured to communicate fluid between an outer surface of the control valve and the valve cavity; a valve sleeve having a sleeve cavity that receives the control valve, an annular groove on an outer surface of the valve sleeve, a plurality of apertures configured to communicate fluid between the sleeve cavity and the outer surface of the valve sleeve, and a planar valve seat surface on the outer surface of the valve sleeve; and a reed valve, received by the annular groove, includes a planar section that is biased into engagement with the planar valve seat surface to releasably seal the aperture(s) and permit the flow of fluid from one of an advance fluid chamber or a retard fluid chamber to the other of the advance fluid chamber or a retard fluid chamber.

DETAILED DESCRIPTION

A control valve assembly used with a variable camshaft timing (VCT) device includes one or more reed valves positioned on an outer surface of a valve sleeve that function as check valves for hydraulic VCT devices. In past control valve implementations, check valves in the form of ball or disk valves have been positioned within a control valve cavity thereby increasing the axial length as well as the complexity of the control valve assembly. Valves positioned within the control valve cavity include more parts, are often press fit within the cavity, and may need to be flow tested to verify their seat geometry. In contrast, positioning reed check valves away from a control valve cavity and on the outer surface of the valve sleeve can be implemented as part of external surface machining already performed on the valve sleeve and can reduce the overall length of the control valve assembly.

Embodiments of a variable camshaft timing (VCT) device or phaser 10 and a VCT control valve assembly 12 are presented in the figures and detailed in this description. The VCT phaser 10 and VCT control valve assembly 12 are, in general, equipped in automotive internal combustion engine (ICE) applications. The VCT control valve 12 can be installed at a location in the accompanying ICE at a center bolt site of the VCT housing and rotor. The VCT control valve assembly 12 is capable of carrying out torsional assist (TA) and camshaft torque actuation (CTA) phasing functionalities distinctly and concurrently with the VCT control valve assemblies disclosed herein. Further, as used herein, the terms axially, radially, and circumferentially, and their related grammatical forms, are used in reference to the generally circular and cylindrical shape of the shown control valve and some of its components. In this sense, axially refers to a direction that is generally along or parallel to a central axis of the circular and cylindrical shape, radially refers to a direction that is generally along or parallel to a radius of the circular and cylindrical shape, and circumferentially refers to a direction that is generally along or in a similar direction as a circumference of the circular and cylindrical shape.

Figure 1:
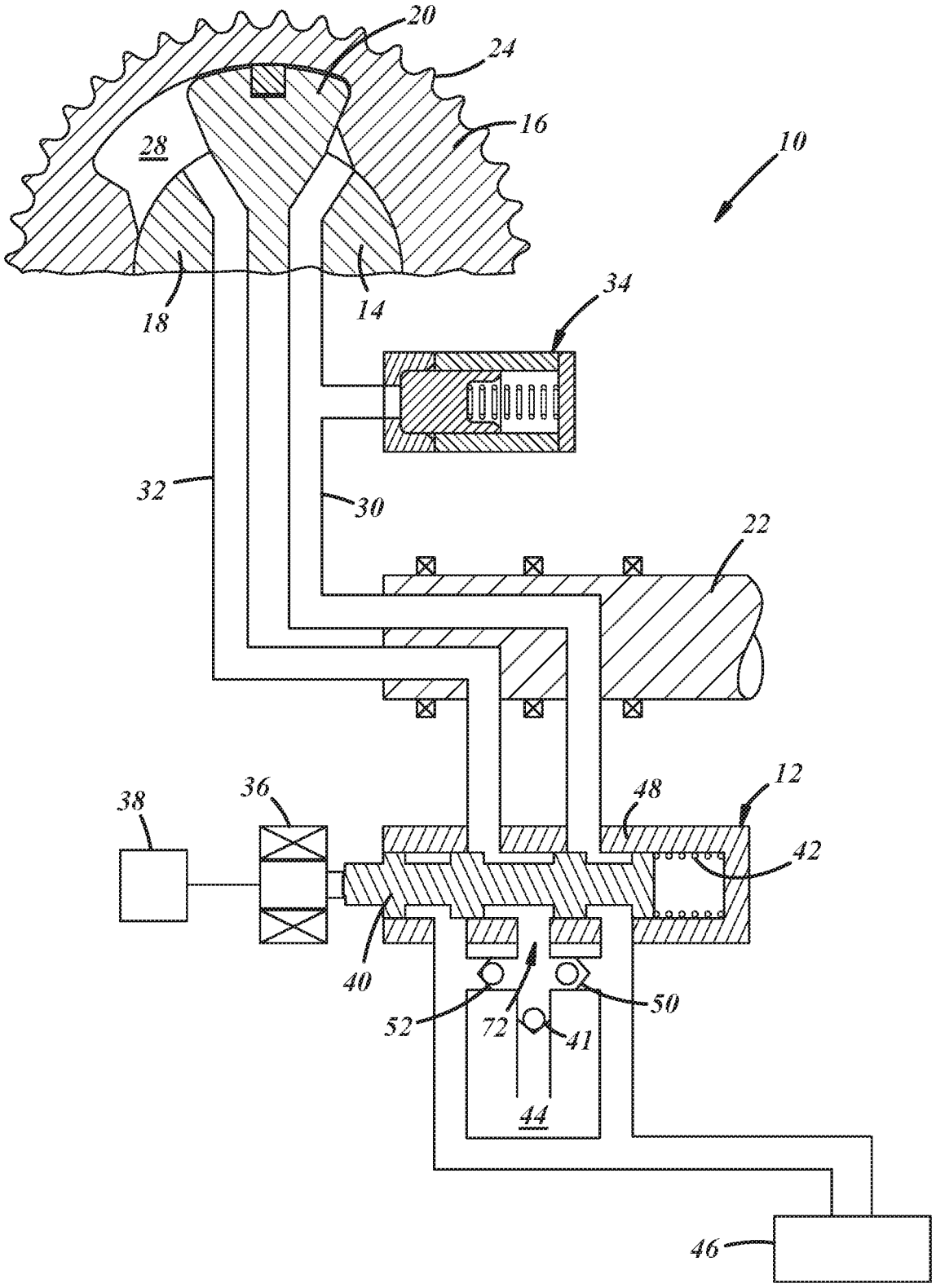
FIG. 1 is a schematic view depicting an implementation of a VCT device.
Figure 2:
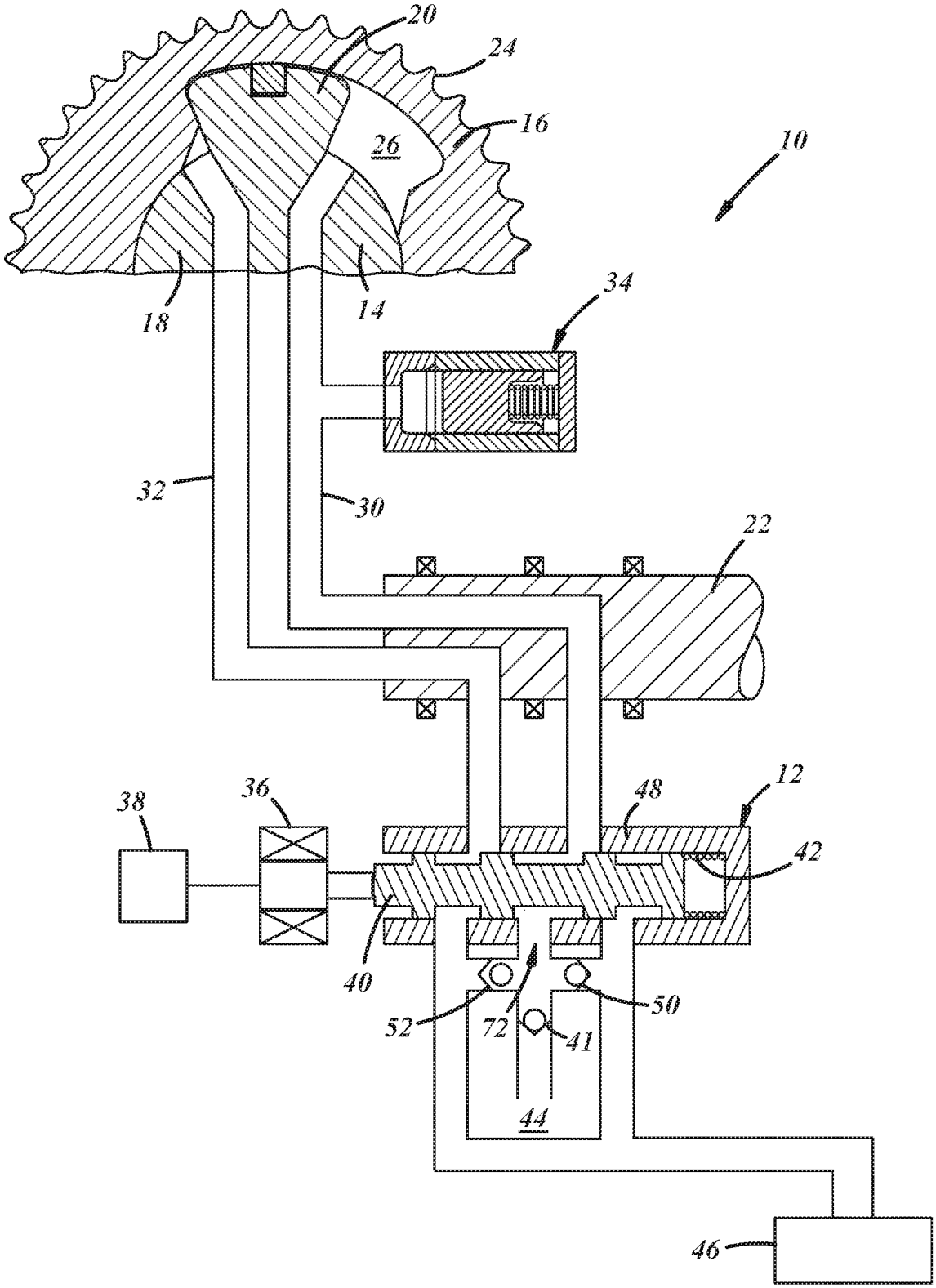
FIG. 2 is another schematic view depicting an implementation of a VCT device.
Figure 3:
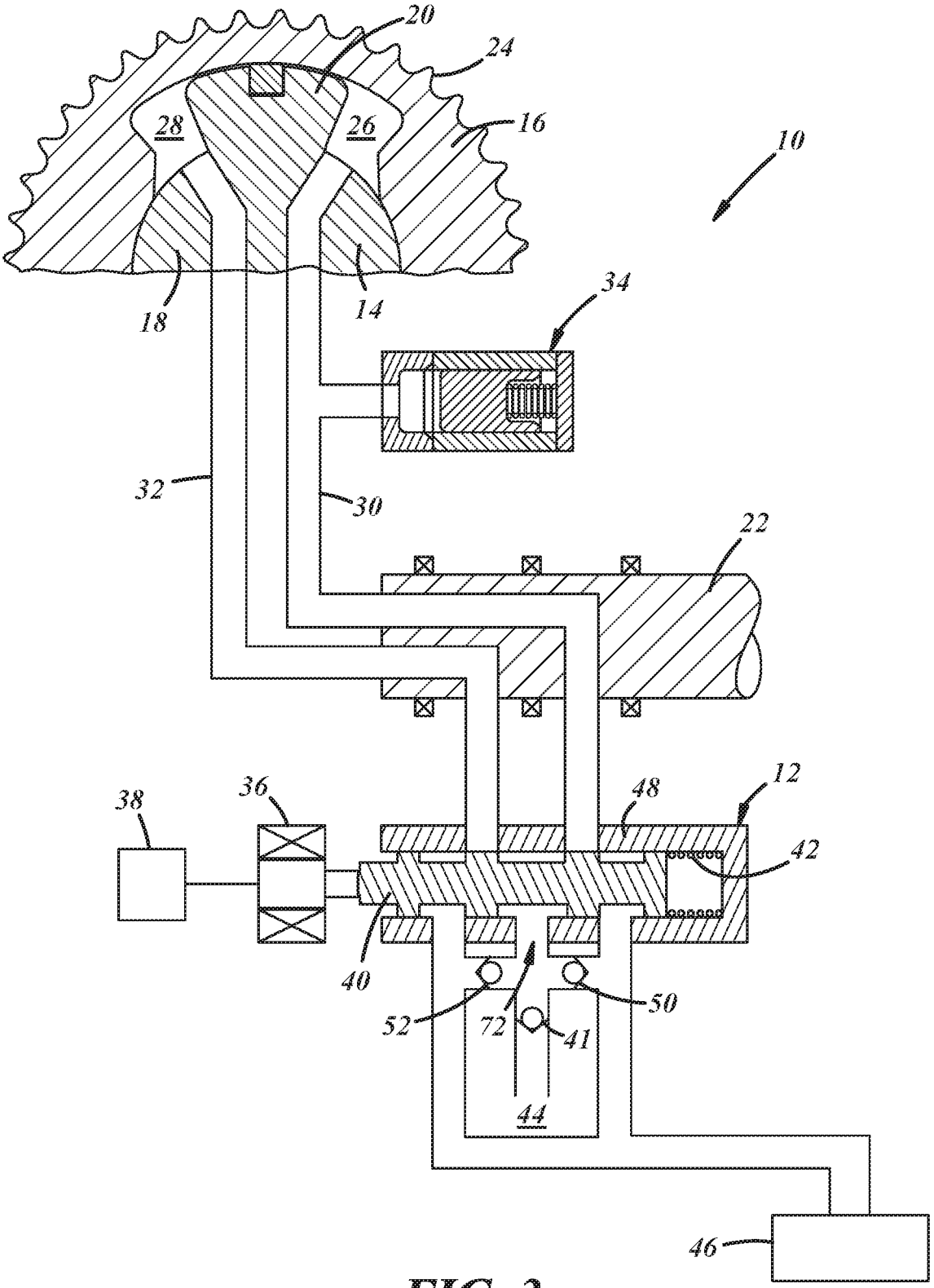
FIG. 3 is another schematic view depicting an implementation of a VCT device.
Figure 4:
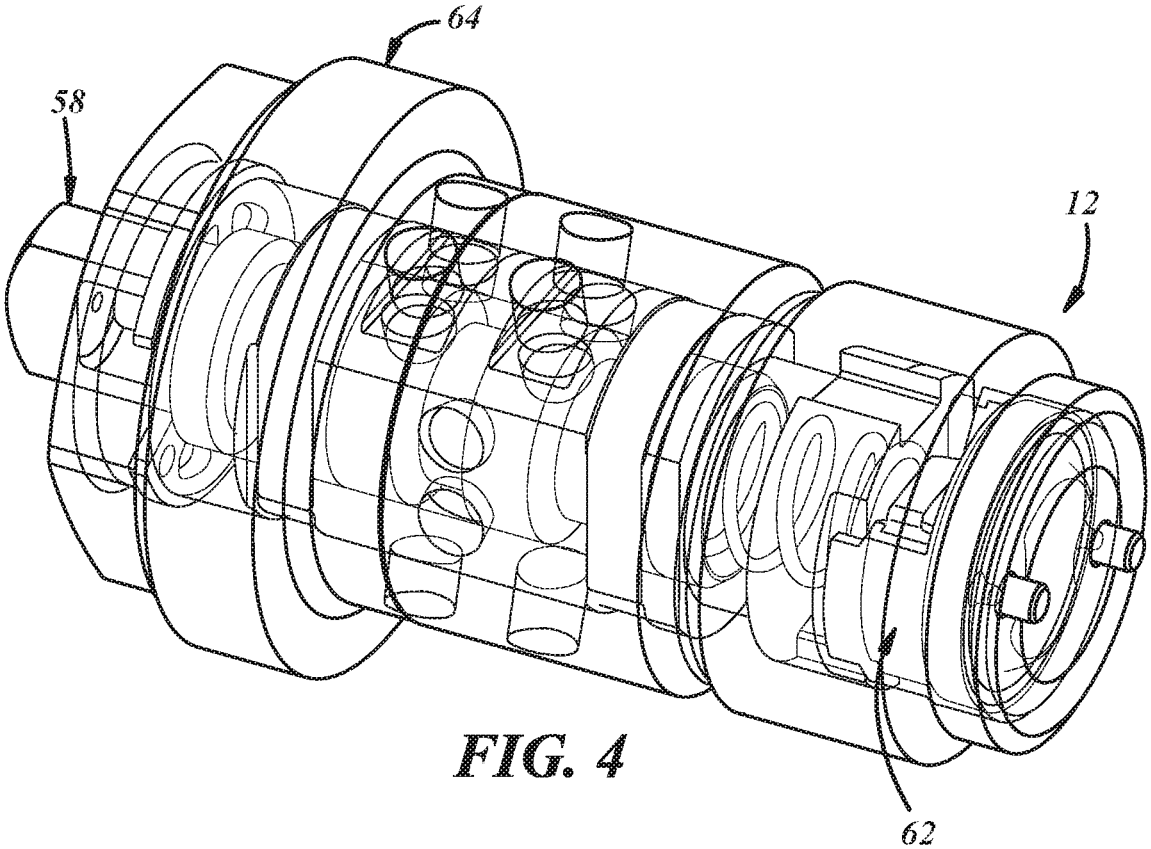
FIG. 4 is a perspective view depicting an implementation of a VCT control valve assembly.

With reference to FIGS. 1-3, the VCT phaser 10 is a hydraulically-actuated VCT phaser assembly and, in general, includes a VCT control valve assembly 12, a rotor 14, and a housing 16. The rotor 14 has a hub 18 and one or more vanes 20 extending radially-outwardly from the hub 18. The rotor 14 is connected to a camshaft 22 so that rotation of the rotor 14 causes rotation of the camshaft 22. The housing 16 can have a camshaft sprocket 24 or a pulley, and partly establishes an advance fluid chamber 26 and a retard fluid chamber 28 with the rotor 14. An endless loop such as a chain or belt engages the camshaft sprocket 24 or pulley and further engages a crankshaft sprocket or other component of the accompanying ICE. By way of the engagement, rotation is transmitted from the ICE to the housing 16, causing the housing 16 to rotate as well. The vane(s) 20 occupy the advance and retard fluid chambers 26, 28, and the fluid chambers 26, 28 receive pressurized fluid via a respective advance line 30 and retard line 32 amid use of the VCT phaser assembly 10. Among its other possible components, the VCT phaser assembly 10 can further include a lock pin assembly 34, an actuator 36 such as a variable force solenoid (VFS) actuator, and a controller 38 such as an engine control unit (ECU). The lock pin assembly 34 is used to maintain the angular position of the rotor 14 with respect to the housing 16. In general terms, the actuator 36 acts on a control valve 40 of the VCT control valve assembly 12 and moves the control valve 40 axially and linearly against the bias of a spring 42 and as commanded by the controller 38. As also depicted schematically in FIGS. 1-3, hydraulic fluid such as oil is selectively introduced to the VCT control valve assembly 12 via a source 44 of the accompanying ICE. The source 44 can be pressurized by a pump. And, at certain times, oil can exit the VCT control valve assembly 12 to a sump or a tank 46 of the accompanying ICE. While an example application of the VCT control valve assembly 12 has now been described, the VCT control valve assembly 12 can be employed in other applications including in other VCT phaser assemblies with different components and workings than presented in FIGS. 1-3 and described with reference thereto.

The VCT control valve assembly 12 helps manage the flow of oil to and from the advance and retard fluid chambers 26, 28 in order to effect advance and retard functionalities of the VCT phaser assembly 10. The VCT control valve assembly 12 can have various designs, constructions, and components depending on the particular ICE application in which the VCT control valve assembly 12 is employed for use. In the embodiment of the figures, the VCT control valve assembly 12 is designed and constructed for carrying out torsional assist (TA) and camshaft torque actuation (CTA) phasing functionalities. The VCT control valve 12, in general, includes a valve housing 48, the control valve 40, an inlet check valve 41, a first recirculation check valve 50, a second recirculation check valve 52, a first recirculation path 54, and a second recirculation path 56; still, more or less and/or different components are possible in other embodiments.

An implementation of the VCT control valve assembly 12 is shown in more detail in FIGS. 4-7. The assembly 12 includes a control valve 58, a valve sleeve 60 that slidably receives the control valve 58, and a supply check valve 62 positioned at one end of the assembly 12. A center bolt housing 64 can receive the VCT control assembly 12 and pass through an axis of rotation of the hydraulically-actuated VCT phaser 10 to secure the phaser 10 to the camshaft 22 of an ICE. The control valve 58 can be an elongated piston having a generally annular shape and one or more lands 66 extending radially-outwardly away from the valve 58 that help control the flow of fluid through the valve 58 and the sleeve 60. The control valve 58 can include a valve cavity 68 so that a radially-inner portion of the valve 58 coinciding with the axis of camshaft rotation is hollow. Two pairs of cavity vents 70 can permit fluid to flow from an outer surface 72 of the control valve 58 into the valve cavity 68. It should be appreciated that the quantity of cavity vents can vary and what is shown and described is one implementation. Here, one plurality of cavity vents 70 receives fluid from the advance fluid chamber 26 when fluid flows into the retard fluid chamber 28 while a second plurality of cavity vents 70 receives fluid from the retard fluid chamber 28 while fluid flows into the advance fluid chamber 26. However, each plurality of cavity vents could be replaced by a single cavity vent receiving fluid from the advance fluid chamber 26 and a single cavity vent receiving fluid from the retard fluid chamber 28. An end 74 of the control valve 58 can be configured to couple with the actuator 36, such as the solenoid, that moves the valve 58 relative to the sleeve 60. An outer diameter 76 of the lands 66 can closely conform to an inner surface 78 of the sleeve 58 to prevent the axial flow of fluid between adjacent lands 66.

The valve sleeve 60 can be an elongated tube with a sleeve cavity 69 that receives the control valve 58 at an open end 90. A plurality of apertures 61 can be formed in the valve sleeve 60 that extend between the sleeve cavity 69 and an outer surface of the sleeve 60. The apertures 61 can form at least a portion of the first recirculation path 54, the second recirculation path 56, the first recirculation check valve 50, or the second recirculation check valve 52. Cavity vents 70 can communicate returning fluid from the advance or retard fluid chambers 26, 28 to the tank 46. The control valve 58 can be biased into a default position by the spring 42 positioned in between the valve 58 and the sleeve 60 within the sleeve cavity 69 to bias the valve 58 in one axial direction. A snap ring 43 can releasably engage with the center bolt housing 64 and help maintain the control valve 58 in the default position. The control valve 58 can be moved axially relative to the valve sleeve 60 by the actuator 36 thereby overcoming the force of the spring 42 to selectively direct fluid through the apertures 61 and control the flow of fluid into the advance fluid chamber 26 or the retard fluid chamber 28. The valve sleeve 60 can be formed from a variety of metals or metal alloys, for example. The outer surface of the valve sleeve 60 can be contoured, such as by machining, to create valve seat surfaces 80. In this implementation, the outer surface of the valve sleeve 60 can be machined to create two substantially planar surfaces 80. The planar surfaces 80 can face in opposite directions 180° apart.

It is also possible to contour the outer surface of the valve sleeve 60 to create at least one annular groove 82 that is shaped to receive a reed-style check valve or reed valve 84. The term reed valve could also be described as a flapper valve, a semi-band valve, a half-band valve or other similar term. The reed valve can include a planar section that is opposably biased into engagement with an orifice through which fluid can flow. In some embodiments, the reed valve can completely encircle the valve sleeve such that the planar section overlaps itself but in other implementations the reed valve may contact less than 360 degrees of the sleeve. The reed valve can generally be implemented as a valve having its spring effort integrated with a valve member.

The reed valve 84 can include two substantially planar sections 86 that are biased into engagement with the valve seats formed by the planar surfaces 80 thereby forming a fluid-tight seal. The planar sections 86 can have a width that is the same as the reed valve material of valve 84 connecting the two sections 86. Fluid exiting an aperture 61 covered by the planar section 86 can overcome the biasing force maintaining the planar section 86 against the planar surface 80 and the movement of fluid in an opposite direction through the aperture 61 is prevented as the planar section 86 is pressed against the planar surface 80 further enhancing the fluid-tight seal. The reed valve 84 can be implemented in a variety of ways, such as by using band checks or a substantially planar material section hinged at one edge. In this implementation, the reed valve 84 can be formed from an elongated length of planar metal that can be bent and/or curved using metal working techniques so that the reed valve 84 closely conforms to an outer surface of the valve sleeve 60. The bending of the reed valve 84 can impart an inherent biasing force that clamps the reed valve 84 to the valve sleeve 60 in the annular groove 82.

The supply check valve 62 can be attached to the valve sleeve 60 at a location opposite the open end 90. The supply check valve 62 can regulate the supply of fluid from the source 44, such as an engine oil pump, to the VCT control valve assembly 12. The supply check valve 62 can include a sleeve engagement section 92 and a center bolt engagement section 94 that mechanically connects the valve 62 to the sleeve 60 and the center bolt housing 64. The features 92, 94 can prevent the angular rotation of the supply check valve 62 relative to the sleeve 60 and the center bolt housing 64 and facilitate the precise angular positioning of these elements relative to each other. The supply check valve 62 can selectively permit the flow of fluid from the source 44 to an outer surface of the valve sleeve 60 where the fluid can flow through selected apertures 61 based on the axial position of the control valve 58 relative to the valve sleeve 60.

The center bolt housing 64 can include a housing cavity 96 that receives the VCT control valve assembly 12. An advance fluid aperture 98 and a retard fluid aperture 100 can communicate fluid from an outer surface of the control valve 58 through the apertures 61 and, ultimately, to the advance fluid chamber 26 and retard fluid chamber 28, respectively. One or more openings 102 at an axial end of the center bolt housing 64 can receive the center bolt engagement section 94. The center bolt housing 64 along with the VCT control valve assembly 12 can be inserted into a hydraulically-actuated VCT phaser 10 through a center of the rotor 14.

Figure 6:
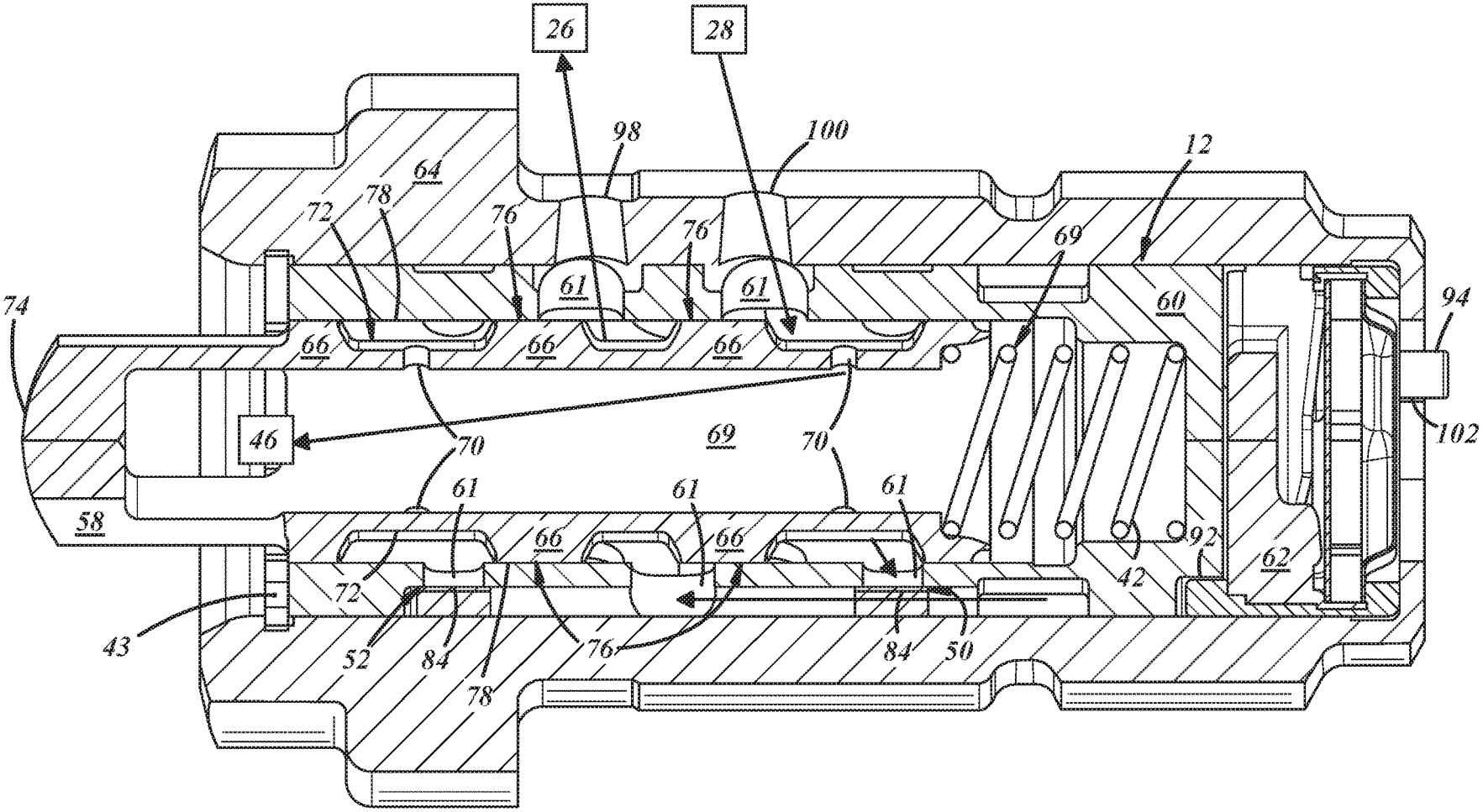
FIG. 6 is a cross-sectional view depicting an implementation of a VCT control valve assembly.

During operation, the VCT control valve assembly 12 can direct fluid to the advance fluid chamber 26 when the control valve 58 is positioned with respect to the valve sleeve as is shown in FIG. 6. Fluid can move through the supply check valve 62 along an outer surface of the valve sleeve 60 flowing from the outer surface of the valve sleeve 60 toward an outer surface 72 of the control valve 58 through an aperture 61. The first recirculation check valve 50 can close helping direct the fluid from the outer surface 72 of the control valve 58 through an aperture 61 in the valve sleeve 60 and the advance fluid aperture 98 toward the advance fluid chamber 26. Fluid leaving the retard fluid chamber 28 can flow through the retard fluid aperture 100 toward the valve sleeve 60 and an aperture 61 to the outer surface 72 of the control valve 58 and through a first pair of cavity vents 70 through the valve cavity 68 where the fluid can pass out the control valve 58 and to the tank 46. When the pressure of fluid leaving the retard chamber 28 exceeds the pressure of fluid from the source 44, fluid from the first plurality of vents 70 can open the first recirculation check valve 50 separating the reed valve 84 from the valve seat and ultimately flow into the advance fluid chamber 26.

Figure 7:
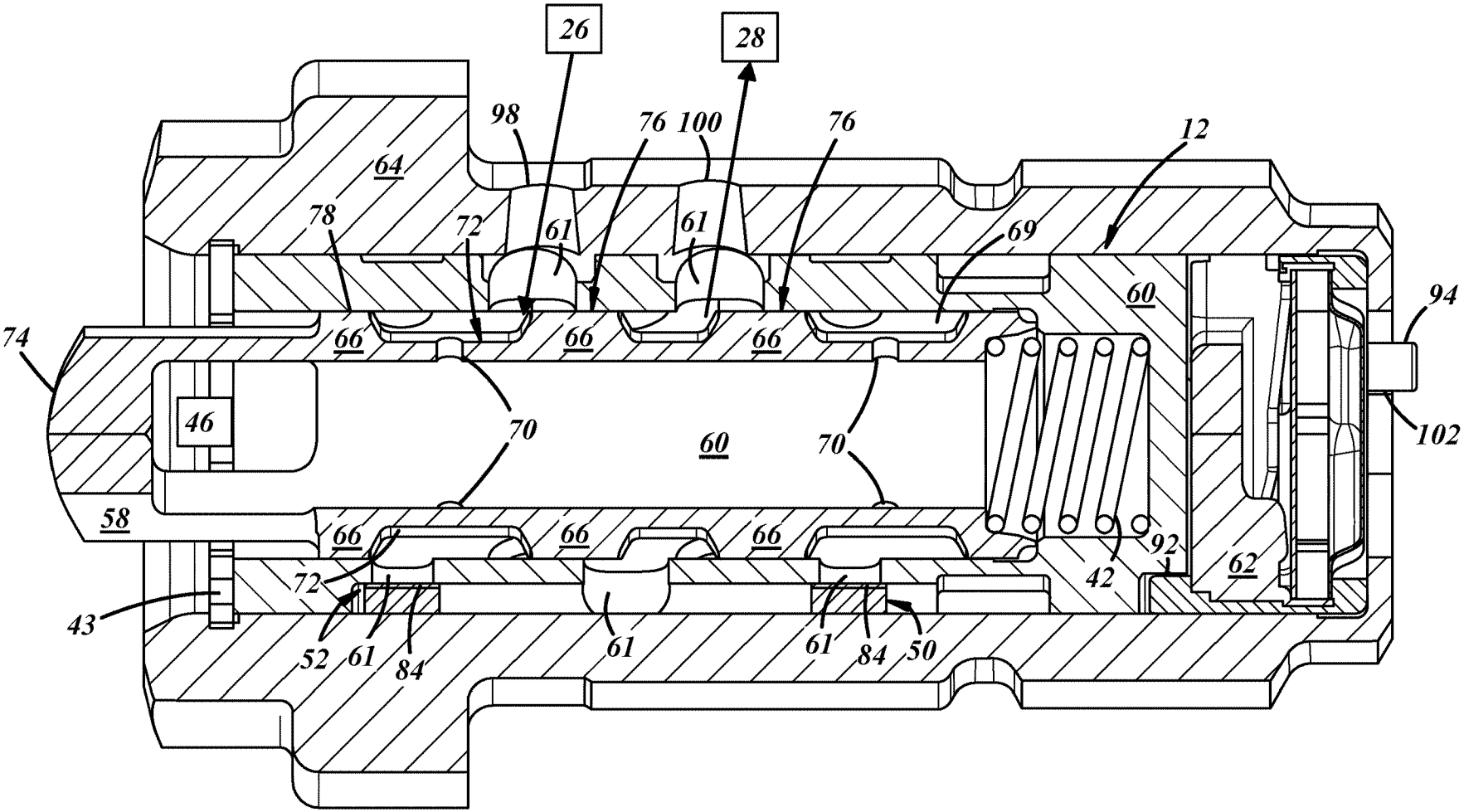
FIG. 7 is another cross-sectional view depicting an implementation of a VCT control valve assembly.

When the control valve 58 is positioned with respect to the valve sleeve as is shown in FIG. 7, fluid can move through the supply check valve 62 along an outer surface of the valve sleeve 60 flowing from the outer surface of the valve sleeve 60 toward an outer surface 72 of the control valve 58. The second recirculation check valve 52 can remain closed helping direct the fluid from the outer surface 72 of the control valve 58 through an aperture 61 in the valve sleeve 60 and the retard fluid aperture 100 toward the retard fluid chamber 28. Fluid leaving the advance fluid chamber 26 can flow through the advance fluid aperture 98 toward the valve sleeve 60 and an aperture 61 to the outer surface 72 of the control valve 58. The fluid leaving the advance fluid chamber 26 can flow through a second pair of cavity vents 70 through the valve cavity 68 where the fluid may pass out the second recirculation check valve 52, and/or the second pair of cavity vents 70 and to the tank 46. When the pressure of fluid leaving the advance chamber 26 exceeds the pressure of fluid from the source 44, fluid from the second plurality of vents 70 can open the second recirculation check valve 52 separating the reed valve 84 from the valve seat and ultimately flow into the retard fluid chamber 28.

Figure 8:
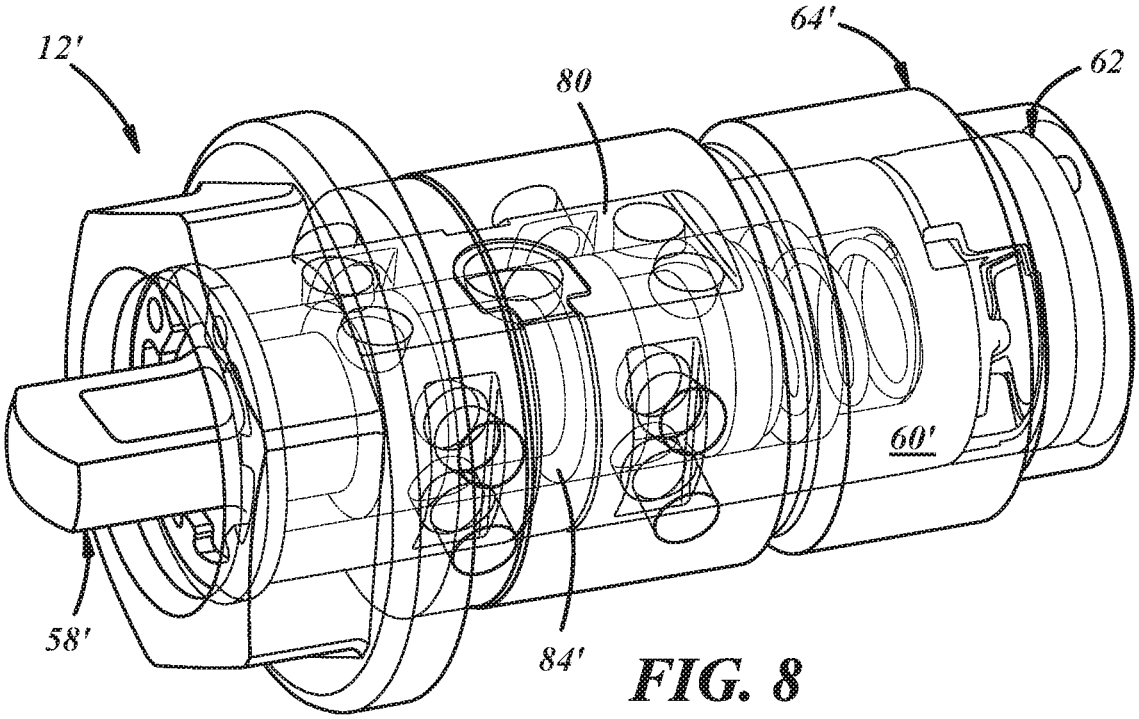
FIG. 8 is a perspective view depicting another implementation of a VCT control valve assembly.
Figure 5:
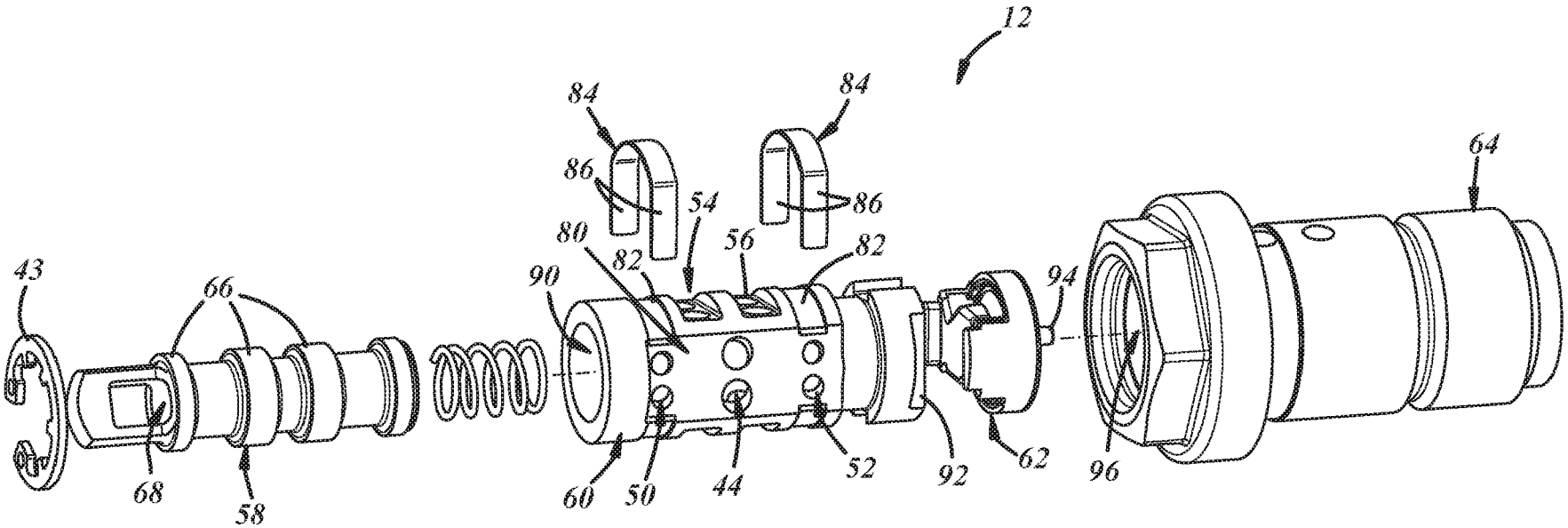
FIG. 5 is an exploded view depicting an implementation of a VCT control valve assembly.
Figure 9:
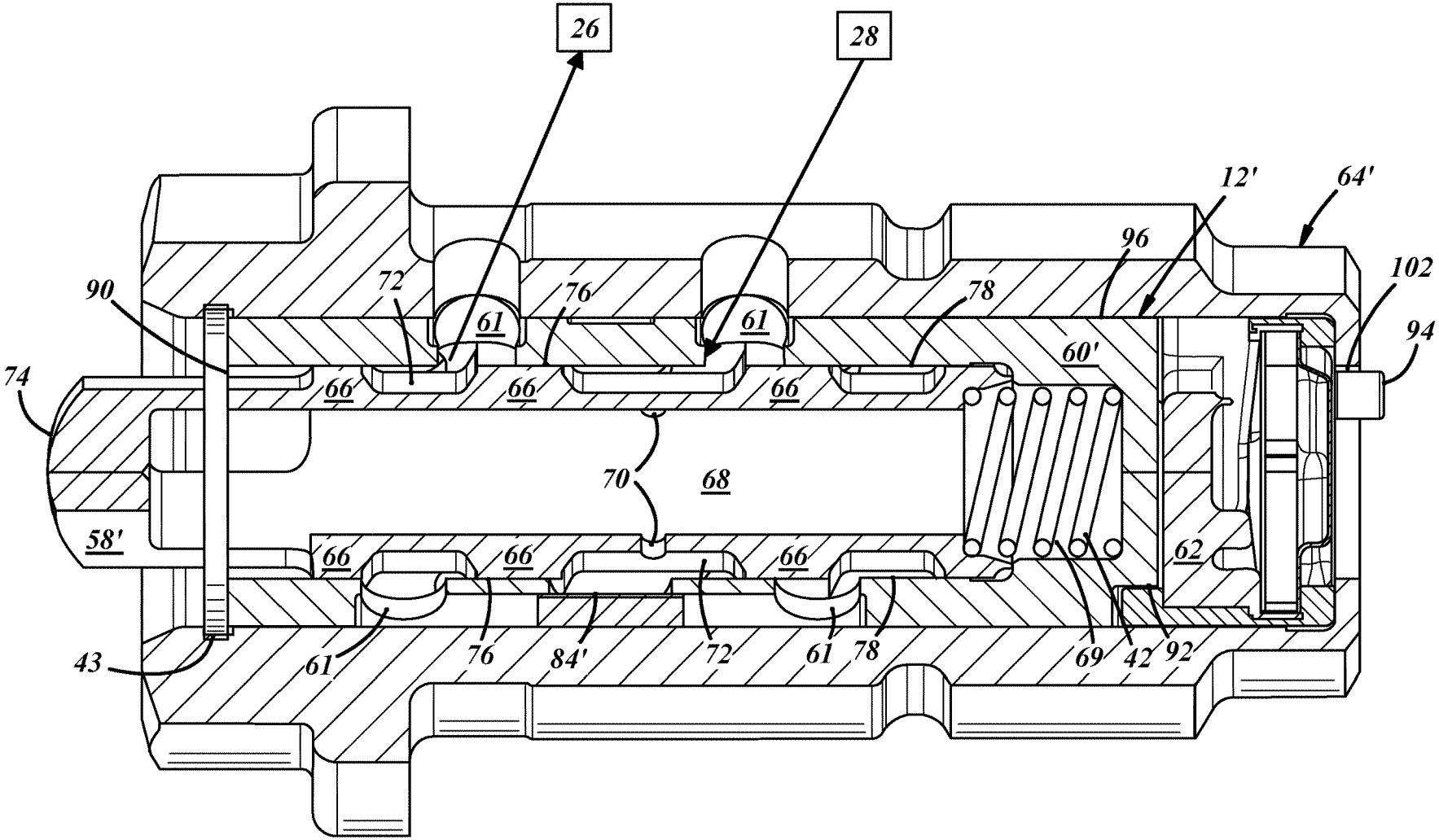
FIG. 9 is a cross-sectional view depicting another implementation of a VCT control valve assembly.
Figure 10:
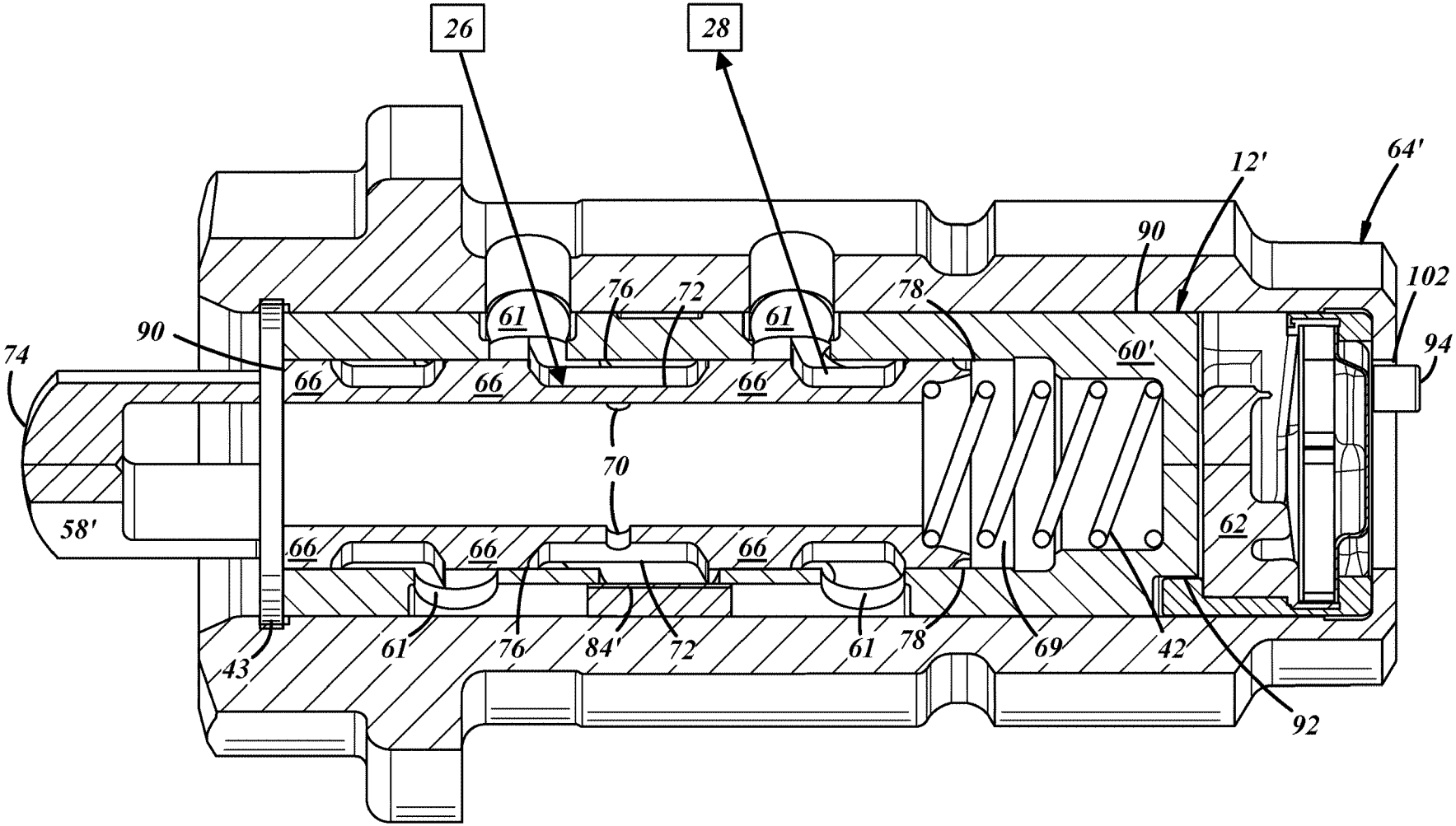
FIG. 10 is a cross-sectional view depicting another implementation of a VCT control valve assembly.

Turning to FIGS. 8-10, another implementation of the VCT control valve assembly 12' is shown. The assembly 12' includes a control valve 58', a valve sleeve 60' that slidably receives the control valve 58', and a supply check valve 62 positioned at one end of the assembly 12'. The control valve 58' includes a single pair of cavity vents 70 used to recirculate fluid when fluid is flowing into the advance fluid chamber 26 and out of the retard fluid chamber 28 or vice versa. The valve sleeve 60' includes a single recirculation reed check valve 84'. The center bolt housing 64 can receive the VCT control assembly 12' and pass through an axis of rotation of the hydraulically-actuated VCT phaser 10 to secure the phaser 10 to the camshaft 22 of an ICE. The control valve 58' can be an elongated piston having a generally annular shape and one or more lands 66 extending radially outwardly away from the valve 58' that help control the flow of fluid through the valve 58' and the sleeve 60'. The control valve 58' can include the valve cavity 68 so that a radially-inner portion of the valve 58 coinciding with the axis of camshaft rotation (x) is hollow. The single pair of cavity vents 70 can permit fluid to flow from an outer surface 72 of the control valve 58 into the valve cavity 66 when fluid is flowing into the advance fluid chamber 26 and out of the retard fluid chamber 28 or when fluid is flowing into the retard fluid chamber 28 and out of the advance fluid chamber 26. That is, all of the cavity vents 70 in the control valve 58 can be used at the same time during phasing, or movement of fluid into or out of the chambers 26, 28. Also, while this implementation depicts two cavity vents 70, different quantities of cavity vents are possible. An end 74 of the control valve 58 can be configured to couple with a linear actuator, such as a solenoid, that moves the valve 58' relative to the sleeve 60'.

The valve sleeve 60' can be an elongated tube with the sleeve cavity 69 that receives the control valve 58' at the open end 90. One or more apertures 61 can be formed in the valve sleeve 60' that extend between the sleeve cavity 69 and an outer surface of the sleeve 60'. The apertures 61 can form at least a portion of the first recirculation path 54, the second recirculation path 56, the first recirculation check valve 50, or the second recirculation check valve 52. Cavity vents 70 can communicate return fluid from the advance or retard fluid chambers 26, 28 to the tank 46. The control valve 58' can be biased into a default position by the spring 42 positioned in between the valve 58' and the sleeve 60' within the sleeve cavity 69 to bias the valve 58' in one axial direction. A snap ring 43 can releasably engage with the center bolt housing 64 and help maintain the control valve 58' in the default position. The control valve 58' can be moved axially relative to the valve sleeve 60' by the actuator 36 thereby overcoming the force of the spring 42 to selectively direct fluid through the apertures 61 and control the flow into the advance fluid chamber 26 or the retard fluid chamber 28. The outer surface of the valve sleeve 60' can be contoured, such as by machining, to create valve seat surfaces 80. In this implementation, the outer surface of the valve sleeve 60' can be machined to create two substantially planar surfaces 80. The planar surfaces 80 can face in opposite directions 180° apart. It is also possible to contour the outer surface of the valve sleeve 60' to create the annular groove 82 that is shaped to receive a reed-style check valve or reed valve 84'.

The reed valve 84' can include two substantially planar sections 86' having a width or surface area that is greater than the portion of the reed valve 84' that connects the two sections 86. The planar sections 86' can be biased into engagement with the valve seat formed by the planar surfaces 80 thereby forming a fluid-tight seal. Fluid exiting an aperture 61 covered by the planar section 86' can overcome the biasing force maintaining the planar section 86' against the planar surface 80 and the movement of fluid in an opposite direction through the aperture 61 is prevented as the planar section 86' is pressed against the planar surface 80 further enhancing the fluid-tight seal. Reed valves can be implemented in a variety of ways, such as by using band checks or a substantially planar material section hinged at one edge. In this implementation, the reed valve 84 can be formed from an elongated length of planar metal that may have been stamped and can be bent and/or curved using metal working techniques so that the reed valve 84' closely conforms to an outer surface of the valve sleeve 60'. The bending of the reed valve 84' can impart an inherent biasing force that clamps the reed valve 84' to the valve sleeve 60' in the annular groove 82. The supply check valve 62 can be attached to the valve sleeve 60' at a location opposite an open end 90. The supply check valve 62 can regulate the supply of fluid from the source 44, such as an engine oil pump, to the VCT control valve assembly 12' as described above.

The center bolt housing 64 can include the housing cavity 96 that receives the VCT control valve assembly 12'. The advance fluid aperture 98 and the retard fluid aperture 100 can communicate fluid from an outer surface of the control valve 58' through the apertures 61 and, ultimately, to the advance fluid chamber 26 and retard fluid chamber 28, respectively. Openings 102 at the axial end of the center bolt housing 64 can receive the center bolt engagement section 94. The center bolt housing 64 along with the VCT control valve assembly 12' can be inserted into a hydraulically-actuated VCT phaser 10 through a center of the rotor 14.

During operation, the VCT control valve assembly 12' can direct fluid to the advance fluid chamber 26 when the control valve 58' is positioned with respect to the valve sleeve 60' as is shown in FIG. 9. Fluid can move through the supply check valve 62 along an outer surface of the valve sleeve 60' flowing into an aperture 61 from the outer surface of the valve sleeve 60' toward an outer surface 72 of the control valve 58'. The fluid can then flow through another aperture 61 into the advance fluid aperture 98 toward the advance fluid chamber 26. Fluid leaving the retard fluid chamber 28 can pass through the retard fluid aperture 100 and an aperture 61 toward an outer surface 72 of the control valve 58'. The reed valve 84' can open when the pressure of fluid from the retard fluid chamber 28 is greater than the pressure of fluid provided by the source 44 helping direct the fluid returning from the retard fluid chamber 28 to the advance fluid chamber 26 while also permitting fluid from the outer surface 72 of the control valve 58 through cavity vents 70 into the valve cavity 68 where the fluid can pass out the open end of the sleeve 60' and into the tank 46.

When the control valve 58 is positioned with respect to the valve sleeve 60' as is shown in FIG. 10, fluid can move through the supply check valve 62 along an outer surface of the valve sleeve 60' flowing into an aperture 61 from the outer surface of the valve sleeve 60' toward an outer surface 72 of the control valve 58'. The fluid can then flow through another aperture 61 into the retard fluid aperture 100 to the retard fluid chamber 28. Fluid leaving the advance fluid chamber 26 can pass through the advance fluid aperture 98 and an aperture 61 toward an outer surface 72 of the control valve 58'. The reed valve 84' can open when the pressure of fluid from the advance fluid chamber 26 is greater than the pressure of fluid provided by the source 44 helping direct the fluid returning from the advance fluid chamber 26 to the retard fluid chamber 28 while also permitting fluid from the outer surface 72 of the control valve 58 through cavity vents 70 into the valve cavity 68 where the fluid can pass out the open end of the sleeve 60' and into the tank 46.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A variable camshaft timing (VCT) control valve assembly, comprising:

a control valve having one or more lands and a valve cavity, wherein one or more cavity vents are configured to communicate fluid between an outer surface of the control valve and the valve cavity;

a valve sleeve having a sleeve cavity that receives the control valve and a plurality of apertures, at least one of the apertures is configured to be in fluid communication with an advance fluid chamber of a VCT device and another of the apertures is configured to be in fluid communication with a retard fluid chamber, wherein the control valve slides axially relative to the valve sleeve; and one or more reed valves, on an outer surface of the valve sleeve, configured to control the flow of fluid between one of the advance fluid chamber or the retard fluid chamber and the other of the advance fluid chamber or the retard fluid chamber.

2. The VCT control valve assembly recited in claim 1, wherein the reed valve(s) are in fluid communication with the cavity vent(s).

3. The VCT control valve assembly recited in claim 1, further comprising a pair of cavity vents.

4. The VCT control valve assembly recited in claim 1, further comprising a plurality of pairs of cavity vents.

5. The VCT control valve assembly recited in claim 1, further comprising a center bolt housing configured to receive the control valve and the valve sleeve, and attach the VCT control valve assembly to a VCT device or a camshaft of an internal combustion engine.

6. The VCT control valve assembly recited in claim 1, wherein the valve sleeve further comprises a planar valve seat surface.

7. The VCT control valve assembly recited in claim 1, further comprising a supply check valve, at one end of the control sleeve, configured to regulate the supply of fluid from a source to the valve sleeve.

8. The VCT control valve assembly recited in claim 1, wherein the reed valve further comprises two planar sections that are connected, wherein the planar sections have a greater width than the section of the reed valve connecting the planar sections.

9. A variable camshaft timing (VCT) control valve assembly, comprising:

a control valve having one or more lands and a valve cavity, wherein one or more cavity vents are configured to communicate fluid between an outer surface of the control valve and the valve cavity;

a valve sleeve having a sleeve cavity that receives the control valve and a plurality of apertures, at least one of the apertures is configured to be in fluid communication with an advance fluid chamber of a VCT device and another of the apertures is configured to be in fluid communication with a retard fluid chamber, wherein the control valve slides axially relative to the valve sleeve; and a first reed valve, on an outer surface of the valve sleeve, configured to control the flow of fluid between the advance fluid chamber and the retard fluid chamber and a second reed valve, on an outer surface of the valve sleeve, configured to control the flow of fluid between the retard fluid chamber and the advance fluid chamber.

10. The VCT control valve assembly recited in claim 9, wherein the first reed valve is in fluid communication with a first cavity vent and the second reed valve is in fluid communication with a second cavity vent.

11. The VCT control valve assembly recited in claim 9, wherein the first reed valve is in fluid communication with a first pair of cavity vents and the second reed valve is in fluid communication with a second pair of cavity vents.

12. The VCT control valve assembly recited in claim 9, further comprising a center bolt housing configured to receive the control valve and the valve sleeve, and attach the VCT control valve assembly to a VCT device or a camshaft of an internal combustion engine.

13. The VCT control valve assembly recited in claim 9, wherein the valve sleeve further comprises a plurality of planar valve seat surfaces.

14. The VCT control valve assembly recited in claim 9, further comprising a supply check valve, at one end of the control sleeve, configured to regulate the supply of fluid from a source to the valve sleeve.

15. The VCT control valve assembly recited in claim 9, wherein the first reed valve or the second reed valve further comprises two planar sections that are connected, wherein the planar sections have a greater width than the section of the reed valve connecting the planar sections.

16. A variable camshaft timing (VCT) control valve assembly, comprising:

a control valve having one or more lands and a valve cavity, wherein one or more cavity vents are configured to communicate fluid between an outer surface of the control valve and the valve cavity;

a valve sleeve having a sleeve cavity that receives the control valve, an annular groove on an outer surface of the valve sleeve, a plurality of apertures configured to communicate fluid between the sleeve cavity and the outer surface of the valve sleeve, and a planar valve seat surface on the outer surface of the valve sleeve; and a reed valve, received by the annular groove, includes a planar section that is biased into engagement with the planar valve seat surface to releasably seal the aperture(s) and permit the flow of fluid from one of an advance fluid chamber or a retard fluid chamber to the other of the advance fluid chamber or the retard fluid chamber.

17. The VCT control valve assembly recited in claim 16, wherein the reed valve is in fluid communication with the cavity vent(s).

18. The VCT control valve assembly recited in claim 16, further comprising a pair of cavity vents.

19. The VCT control valve assembly recited in claim 16, further comprising a center bolt housing configured to receive the control valve and the valve sleeve, and attach the VCT control valve assembly to a VCT device or a camshaft of an internal combustion engine.

20. The VCT control valve assembly recited in claim 16, wherein the valve sleeve further comprises a planar valve seat surface.

* * * * *